US005340118A

United States Patent [19]

Jacobson et al.

[11] Patent Number: 5,340,118

[45] Date of Patent: Aug. 23, 1994

[54] PLAYING COURT

[76] Inventors: Richard B. Jacobson; Michael Abrams, both of 31-31 138 St., Flushing, N.Y. 11354

[21] Appl. No.: 70,269

[22] Filed: Jun. 2, 1993

[51] Int. Cl.[5] ..... A63B 71/04; A63C 19/00

[52] U.S. Cl. ..... 273/411; 472/94

[58] Field of Search ..... 273/411, 123 R; 472/92, 472/94; 473/3

[56] References Cited

U.S. PATENT DOCUMENTS

| | | | |
|---|---|---|---|
| 278,341 | 5/1883 | Kelly | 273/123 R |
| 4,068,840 | 1/1978 | Spaulding, Jr. | 273/411 X |
| 4,449,712 | 5/1984 | Benedyk et al. | 273/411 X |
| 4,461,469 | 7/1984 | Henson | 273/411 X |
| 4,518,166 | 5/1985 | Trott | 273/411 |
| 4,962,935 | 10/1990 | Williams | 273/411 |

*Primary Examiner*—William H. Grieb

[57] ABSTRACT

An enclosed or open playing court, of generally rectangular shape, has two vertical end walls and two vertical side walls with four traps or alcoves spaced along the side walls. The court is bounded by a floor below, and optionally a ceiling above. The vertical end walls at each end of the court are the scoring walls. Players typically stand at each end of the court and face each other. A resilient rubber ball is caught and thrown by hand. The play consists of throwing the ball towards the opponent's scoring wall. The ball must bounce twice on the floor within a designated area, before being caught by the other player, or striking the opponent's scoring wall at a minimum height above the floor. In normal play, after the ball is caught by the other player, it is returned by throwing the ball towards the scoring wall defended by first player. To score a point, the ball must pass the other player and hit the back wall.

7 Claims, 3 Drawing Sheets

PLAYING COURT

FIELD OF THE INVENTION

The present invention related to a playing court for playing a ball game.

BACKGROUND OF THE INVENTION

Numerous playing courts for the playing of ball games are well known. Examples of open playing courts include basketball and tennis courts. Also, known are enclosed courts such as racquetball or hai-alai courts. Various specialty courts, as disclosed in U.S. Pat. Nos. 4,461,469 to Henson, 4,518,166 to Trott and 4,962,935 to Williams for the playing of ball games, are also known.

SUMMARY OF THE PRESENT INVENTION

The present invention is embodied in an enclosed or open playing court comprising two side walls, with four traps or alcoves disposed along the side walls of the court, and two vertical end walls. The court is bounded by a floor below, and optionally a ceiling above. The playing court is compact, suitable for construction in athletic clubs where space is limited, and, with the substitution of transparent walls for opaque walls on one side of the court, provides an excellent arena for exhibition play before spectators.

Players typically stand at each end of the court and face each other. A resilient rubber ball is caught and thrown by hand. The play consists of throwing the ball towards the opponent's vertical end wall, also called the scoring wall. The ball must bounce twice on the floor within a designated area, before being caught by the other player, or striking the opponent's scoring wall. In normal play, after the ball is caught by the other player, it is returned by throwing the ball towards the scoring wall defended by first player. To score a point, the ball must pass the other player and hit the back wall at a minimum height above the floor. If the ball enters an alcove, the player loses a point. Points are also made if the other player fumbles the ball, or if a loose ball is recovered in the opponent's court after a rebound, as set forth below in the playing rules. Play is fast paced in that there are time limits for which a ball may be held out of play.

DETAILED DESCRIPTION

Figure 1:
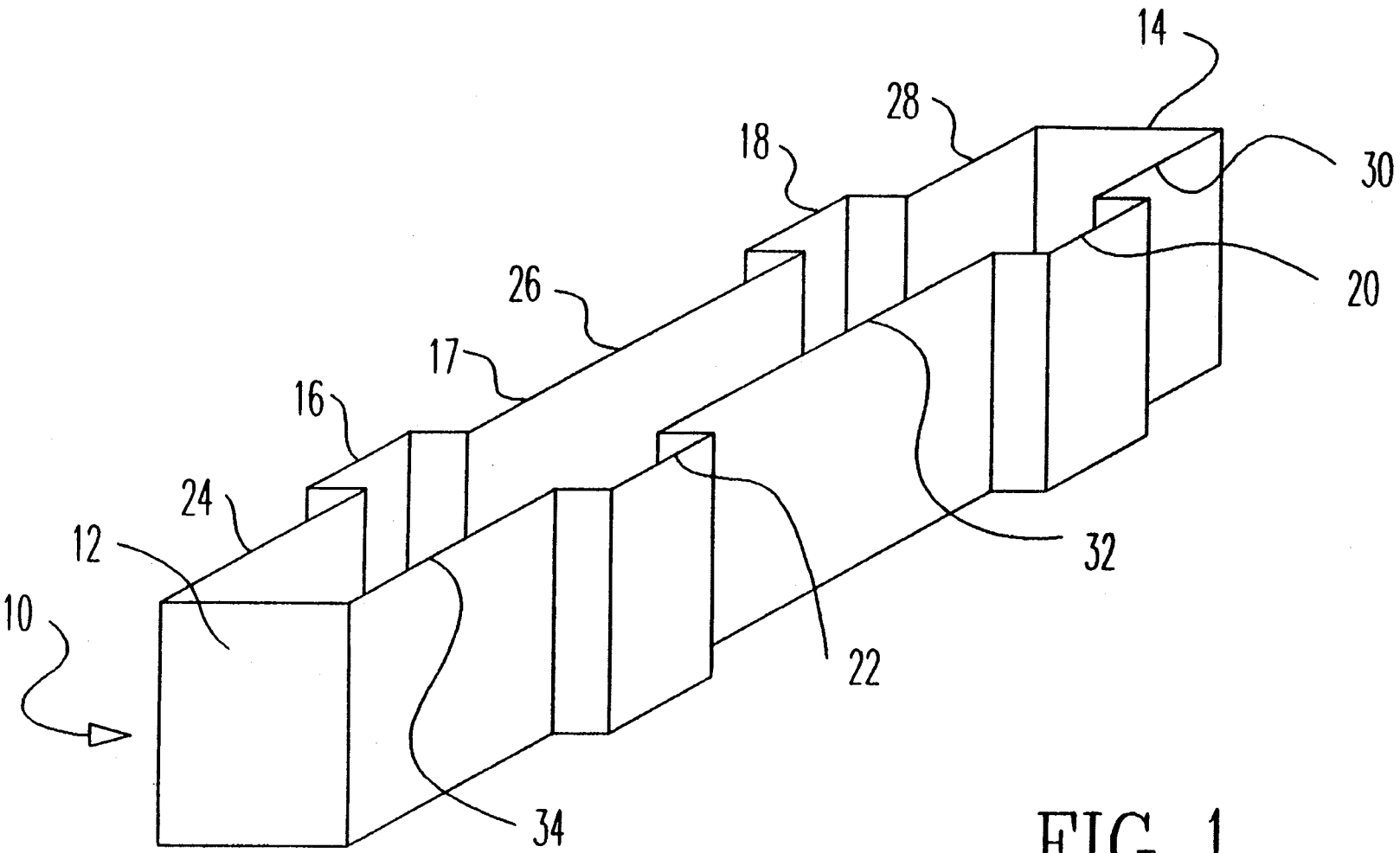
FIG. 1 is an isometric view of a playing court in accordance with the present invention.

As shown in FIG. 1, the playing court 10 consists of vertical end walls 12 and 14, vertical side walls 24, 26, 28, 30, 32 and 34, four alcoves 16, 18, 20 and 22, a floor 11 (shown in FIG. 2) and an optional ceiling (not shown). The four alcoves 16, 18, 20 and 22 are recesses or traps in the vertical side walls. In particular, vertical side walls 24, 26 and 28 are coplanar surfaces, forming a first side wall with two alcoves 16 and 18 along such side wall. Similarly, vertical side walls 30, 32, and 34 are coplanar surfaces, forming a second side wall with two alcoves 20 and 22 along such side wall. The vertical end walls 12 and 14 at each end of the court 10 are the scoring walls. A ball striking an opponent's scoring wall results in a point. Thus, the court 10 is of generally rectangular shape with two end walls and two side walls having four alcoves spaced along the side walls.

Figure 2:
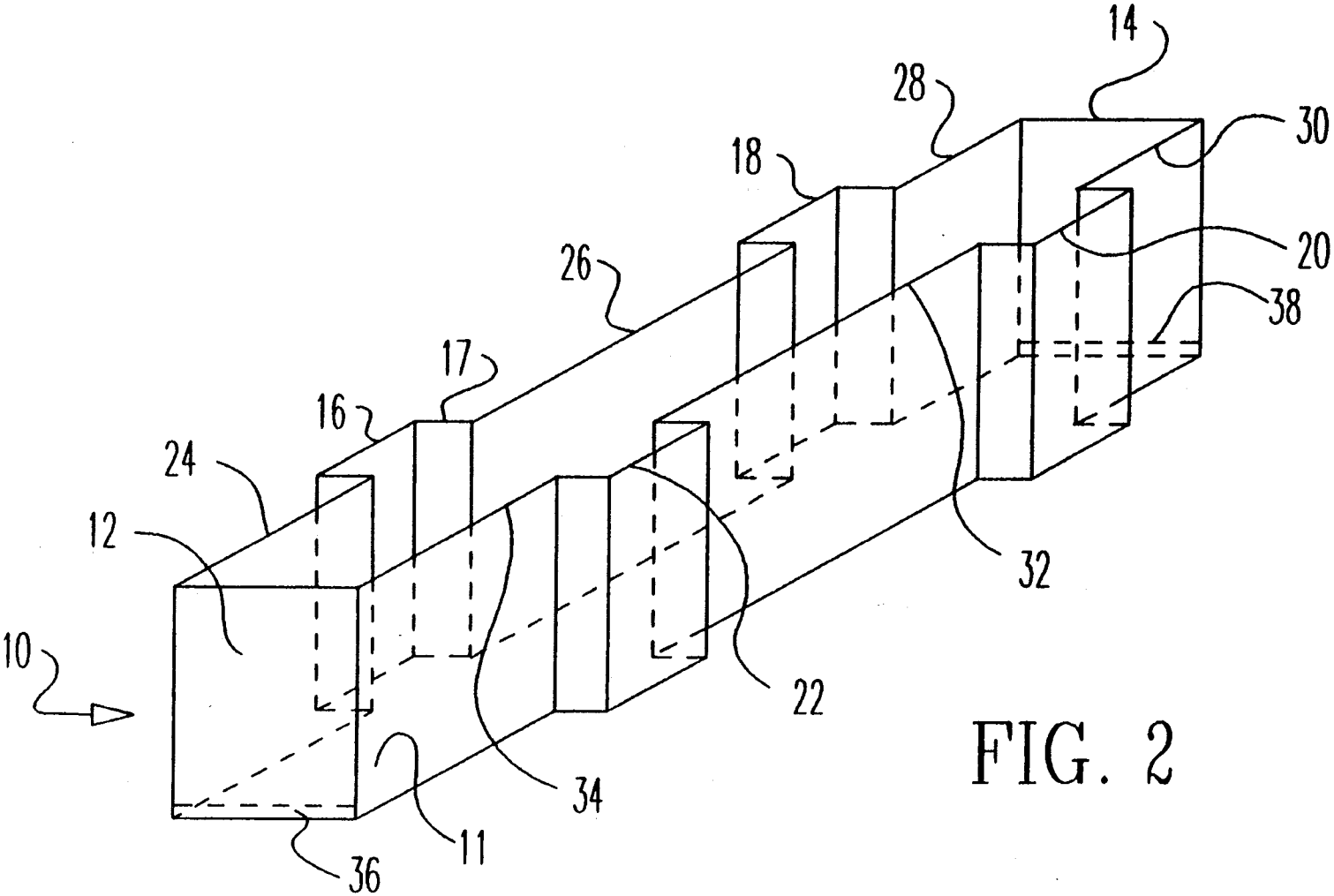
FIG. 2 is an isometric view of a playing court in accordance with the present invention, with dotted (hidden) lines illustrating the interior edges and surfaces of the playing court.

FIG. 2 shows an isometric view of the court 10, with dotted lines to reveal the hidden interior edges and surfaces of the playing court. In particular, the scoring, or end walls 12 and 14 have "dead" regions 36 and 38 respectively, typically constituting the lower 8 inches of each end wall. The purpose of the dead areas 36 and 38 is to avoid very low scoring shots which are hard to catch, and therefore do not provide adequate play. A ball striking either dead area 36 or 38 will make a characteristic sound, and will rebound weakly, thus detecting a low shot. Accordingly, a ball striking the dead areas 36 and 38, loses a point in accordance with the rules below that provide that the ball must hit the scoring wall at least 8 inches above the floor in order to score a point.

Figure 3:
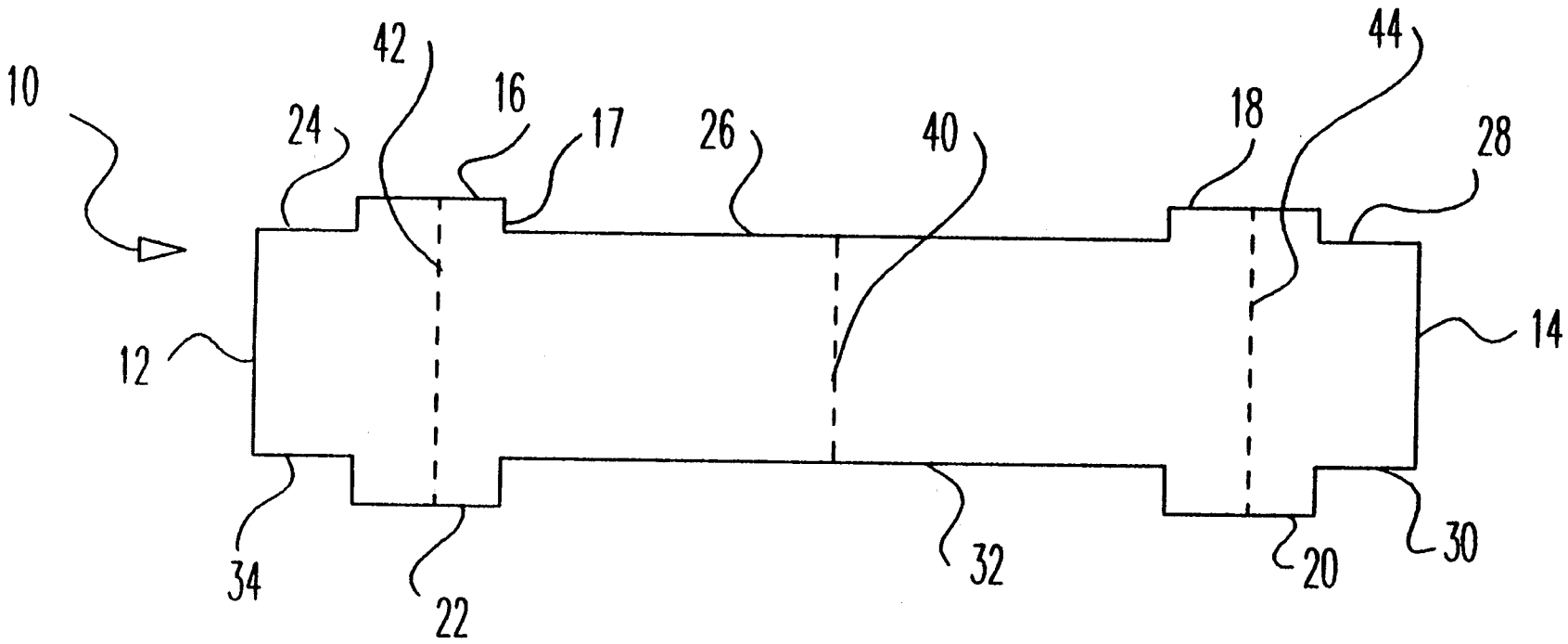
FIG. 3 in a top view plan of a playing court in accordance with the present invention.

A top plan view of the playing court of the present invention is illustrated in FIG. 3. A first player's box consists of the area bounded by end wall 12 and line 42. The second player's box consists of the area bounded by end wall 14 and line 44. A center line 40 divides the court- On the left side of the center line 40 is the first player's court. On the right side of center line 40 is the second player's court. As indicated, a ball caught in the opponent's court after a rebound results in a point. Thus, there are situations where both players charge towards the center line 40 to score or prevent the scoring of a point.

In order to provide lively play, including ricocheting from both side walls, the court 10 is preferably long relative to its width. That is, for a typical overall court length of 42 feet, a typical width is 6 feet. Thus, a nominal length/width ratio is 7:1 although a length to width ratio anywhere from 6:1 to 8:1 is acceptable. The relatively high length to width ratio of the playing court 10 also makes it suitable for installation where space is limited, such as would be available in typical retail storefront commercial space.

The alcoves should be positioned adjacent to each player where each alcove functions to protect against a preemptire passing shot, which will be trapped in the recess of an alcove instead of passing the player. A strategic location of the alcove, such as alcove 16, is beginning 5 feet from the rear wall 12, and extending across the players' line 42. A recommended depth 17 for the alcoves is ½ foot. The alcoves may be replaced by other means for protecting against an equivalent region of the side walls from being used for rebound. Although potential equivalent substitutions for the alcoves as shown, could be a dead zone or simply an open area, an alcove such as a recess which returns the ball to the playing area, is preferable.

RULES OF PLAY

1. To score a point (or lose a point):

a. A player must bounce the ball at least 2 times on the floor of the playing court and hit the opponent's scoring wall.

b. A player attempting to catch an opponent's pitch who "fumbles" the ball, allowing it to hit the floor, shall lose a point.

c. A player throwing the ball into any trap shall lose a point.

d. An opponent attempting to catch an opponents pitch can use the walls to assist him, including balls ricocheting from the player in the process of catching balls, to the wall and back to the player without hitting the ground.

e. Any loose ball bouncing into the playing court can be retrieved by either player. A player retrieving a ball on the opponent's side of the court shall receive one point.

f. Any pitch hitting 2 walls and the scoring wall, shall receive 2 points.

g. Any pitch failing to reach opponent's playing box shall lose a point and the player lose possession of the ball.

Other information

1. A player must be completely in the player's box to catch or pitch a ball.

2. A player shall have (5) five seconds to throw the ball:

a. After catching a pitch.

b. After entering player's box from retrieving ball on playing court.

c. After picking up a "missed pitch".

3. No player shall delay the game.

4. Scoring system: The player who is winning shall call out the difference in the players' score each time a point is won or lost. That is, the first player to score a point shall call out "1". If the first player scores again, the call is "2". If the opponent scores the next point, the first player calls out 1, and so on.

Since the rules are simple and brief, and the major skills necessary to play (throwing and catching a ball) are possessed by most people, the sport is instantly enjoyed and easily learned. The fast pace leads to a highly aerobic workout in the space of 10 minutes. Games are either timed so that after a fixed time, the player in the lead is the winner, or played until a given lead is attained by one player. Alternatively, the game points may be counted to a predetermined level, such as 21 points.

Finally, the opaque walls 30, 32, 34, and alcoves 20 and 22 may be replaced with a transparent material, such as plexiglass in order to form an arena for exhibition play before spectators.

What is claimed is:

1. A playing court for a ball game, comprising:

a horizontal floor;

first and second vertical end walls substantially perpendicular to said horizontal floor, a first side wall substantially perpendicular to said horizontal floor, said first side wall having first and second alcoves spaced along said first side wall, each of said first and second alcoves being respective first and second trap means for preventing a ball entering each said alcove from a normal rebound from said first side wall, each of said trap means forming an entrance area extending substantially from said horizontal floor to the top of said first side wall; and a second side wall substantially perpendicular to said horizontal floor and substantially parallel to said first side wall, said second side wall having third and fourth alcoves along said second side wall, each of said third and fourth alcoves being respective third and fourth trap means for preventing a ball entering each said alcove from a normal rebound from said second side wall, each of said trap means forming an entrance area extending substantially from said horizontal floor to the top of said second side wall.

2. A playing court in accordance with claim 1, wherein the ratio of the length of said first and second side walls to the width of said first and second end walls is between 6:1 and 8:1.

3. A playing court in accordance with claim 1, wherein each said end wall further includes a dead spot disposed between said horizontal floor and a given height above said horizontal floor.

4. A playing court for a ball game, comprising:

a horizontal floor;

first and second vertical end walls substantially perpendicular to said horizontal floor, a first side wall substantially perpendicular to said horizontal floor, said first side wall having first and second alcoves spaced along said first side wall; and a second side wall substantially perpendicular to said horizontal floor and substantially parallel to said first side wall, said second side wall having third and fourth alcoves along said second side wall, wherein each said first, second, third and fourth alcoves each comprise a recessed area of said first and second side walls, respectively.

5. A playing court in accordance with claim 4, wherein the ratio of the length of said first and second side walls to the width of said first and second end walls is between 6:1 and 8:1.

6. A playing court in accordance with claim 4, wherein each said end wall further includes a dead spot disposed between said horizontal floor and a given height above said horizontal floor.

7. A method of playing a game using a court having a horizontal floor having a generally rectangular shape, first and second parallel vertical end walls disposed at opposite ends of said horizontal floor and substantially perpendicular to said horizontal floor, a first side wall substantially perpendicular to said horizontal floor, and a second side wall substantially perpendicular to said horizontal floor and substantially parallel to and equal to said first side wall, a resilient ball, and first and second players, said playing method comprising:

positioning said first and second players facing said second and first vertical end walls respectively, and defending said first and second vertical end walls respectively;

attempting to propel said ball by said first player to strike said second vertical end wall defended by said second player after said ball strikes said horizontal floor twice;

attempting to catch said ball by said second player before it strikes said second vertical end wall; and alternatively attempting to propel said ball by said second and first players, to strike the vertical end wall defended by the other player after said ball strikes said horizontal floor twice, until one of said first and second players fails to catch said ball, and said ball strikes the vertical wall defended by said first or second player, respectively.

* * * * *